US008611774B2

(12) United States Patent
Aslam et al.

(10) Patent No.: US 8,611,774 B2
(45) **Date of Patent: *Dec. 17, 2013**

(54) PRINTING AND FUSING TONER EXTENDED TONER PILES

(75) Inventors: Muhammed Aslam, Rochester, NY (US); Donald S. Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 585 days.

This patent is subject to a terminal disclaimer.

(21) Appl. No.: 12/768,824

(22) Filed: Apr. 28, 2010

(65) Prior Publication Data

US 2011/0268465 A1 Nov. 3, 2011

(51) Int. Cl.
*G03G 15/20* (2006.01)

(52) U.S. Cl.
USPC ..... 399/67; 399/328

(58) Field of Classification Search
USPC ..... 399/67, 68, 69, 328, 335, 341, 342
See application file for complete search history.

(56) References Cited

U.S. PATENT DOCUMENTS

| | | | | |
|---|---|---|---|---|
| 5,572,290 | A | 11/1996 | Ueno et al. | |
| 5,652,949 | A | 7/1997 | Ogawa et al. | |
| 5,887,238 | A | 3/1999 | Matsuzne et al. | |
| 5,956,543 | A | 9/1999 | Aslam et al. | |
| 5,983,048 | A | 11/1999 | Moser | |
| 6,577,840 | B2 | 6/2003 | Hachisuka et al. | |
| 6,909,871 | B2 | 6/2005 | Behnke et al. | |
| 7,468,820 | B2 | 12/2008 | Ng et al. | |
| 7,596,349 | B2 | 9/2009 | Ishiduka | |
| 7,630,674 | B2 | 12/2009 | Behnke et al. | |
| 7,630,677 | B2 | 12/2009 | Osada et al. | |
| 7,912,415 | B2 | 3/2011 | Shiozawa | |
| 2001/0003560 | A1 | 6/2001 | Yokosuka et al. | |
| 2004/0037573 | A1 | 2/2004 | Hirota et al. | |
| 2004/0037598 | A1 | 2/2004 | Behnke et al. | |
| 2006/0187505 | A1 | 8/2006 | Ng et al. | |
| 2007/0230984 | A1* | 10/2007 | Noguchi | 399/69 |
| 2009/0016757 | A1* | 1/2009 | Priebe et al. | 399/58 |
| 2009/0016776 | A1 | 1/2009 | Priebe et al. | |
| 2009/0154948 | A1 | 6/2009 | Cahill et al. | |
| 2009/0297970 | A1 | 12/2009 | Tyagi et al. | |
| 2011/0268465 | A1 | 11/2011 | Aslam et al. | |

FOREIGN PATENT DOCUMENTS

| | | |
|---|---|---|
| JP | 08-063039 | 3/1996 |
| JP | 2002-123108 | 4/2002 |

* cited by examiner

*Primary Examiner* — Billy J Lactaoen
(74) *Attorney, Agent, or Firm* — Roland R. Schindler, II

(57) ABSTRACT

Methods are provided for printing and fusing a toner on a receiver having a toner pile that extends at least about 50 μm above a receiver. According to one aspect, a first energy is applied to raise a temperature of a first portion of the toner pile to a range of elevated temperature levels below a glass transition temperature of the toner, a second energy is applied to a temperature of a second portion of the toner pile above the glass transition temperature and to allow the second portion to transfer energy to the first portion. The second energy is provided at a level that allows the transferred energy to raise the temperature of the first portion from the range of elevated levels to the range of temperatures above the glass transition temperature. a range of temperatures above the glass transition temperature for the toner.

14 Claims, 9 Drawing Sheets

PRINTING AND FUSING TONER EXTENDED TONER PILES

CROSS REFERENCE TO RELATED APPLICATIONS

This application relates to commonly assigned, copending U.S. application Ser. No. 12/768,815, filed Apr. 28, 2010, entitled: "PRINTER AND FUSING SYSTEM") hereby incorporated by reference.

FIELD OF THE INVENTION

This invention relates to methods and appparatii that are used to appropriately fuse electrophotographic toner.

BACKGROUND OF THE INVENTION

In conventional electrophotography, it is known to imagewise apply toner particles in piles on a receiver to form a toner image. The toner image is then fused to form a permanent image that is bound to the receiver. In color electrophotography, fusing is also used to enable two or more colors of toner to mix to form a combination color. Accordingly, proper fusing of electrophotographic toner is essential to the formation of high quality electrophotographic images.

While other types of fusing exist, such as those that involve the use of solvents or pressure differentials, fusing is typically achieved by heating the toner in a toner image to a temperature that is higher than a glass transition temperature of the toner. There are several key variables that impact the effectiveness of such thermal toner fusing. These include the rate at which energy can be supplied by all sources to heat the toner during fusing, the amount of exposure time during which the energy can be applied for the purpose of fusing, the rate at which the energy can be absorbed and transferred by a given unit of the thickness of toner without causing damage to the toner, the toner piles formed on the receiver, and the amount of ambient pressure applied to the toner pile during exposure.

These variables can be combined in a variety of ways to achieve a fusing solution. One variable that is generally held fixed in determining a fusing solution is the stack height of the toner pile on the receiver. Typically, the stack height is controlled to be within a predefined range. This reduces the cost of images printed using the toner and also reduces the number of variables that must be managed when determining a fusing solution. Further, the use of relatively consistent toner pile thickness across a toner image allows all of the other fusing variables to be set once and maintained at a steady state. Typically toner stack heights are maintained in a range of less than about 20 μm.

Various conventional technologies are known that are adapted to thermally fused toner piles that have such managed stack heights. In one example of contact fusing, known as hot roller fusing, a receiver having a toner image applied thereto is passed between a nip and a heated roller or belt. Heat and pressure are applied to the toner image and receiver causing the toner to heat to a temperature at or above the glass transition temperature of the toner. U.S. Pat. No. 6,577,840, entitled "Method and Apparatus for Image Forming Capable of Effectively Performing an Image Fixing Process", issued to Hachisuka et al. on Jun. 10, 2003 shows one example of a heated roller type fuser while U.S. Pat. No. 7,630,677, entitled "Image Heating Apparatus", issued to Osada et al. on Dec. 8, 2009 shows one example of heated belt fuser.

Similarly, various forms of non-contact fusing are known that can cause a toner to be heated. U.S. Pat. No. 7,630,674 entitled "Method and Arrangement for Fusing Toner Images to a Printing Material" shows one example of this.

Combinations of contact fusing and non-contact fusing are also known. For example, U.S. Pat. No. 6,909,871 entitled "Method and Device for Fusing Toner Onto a Substrate" shows a combination of microwave and pressure roller heating to achieve a fusing solution to allow fusing to occur in during abbreviated exposure times in order to enable high rates of printing.

Recently, it has become popular to provide toner images having portions with high toner stack heights such as those that include for example and without limitation stack heights that are on the order of 50 μm to 500 μm. An advantage of such high toner stack heights is that they can be used to form projections from a surface of an image that can impart a three dimensional look and/or feel to an image. This extra dimension, is provided by a contrast in toner stack heights which can range from a conventional stack height to, as noted above, stack heights of up to 500 μm.

Conventional fusing technologies however are not easily applied to the purpose of fusing toner images having toner piles that have high toner stack heights. In part, this is because the rate at which thermal energy can be transferred to and into a unit of toner is such that only a conventional toner pile thickness can be fully fused during a fusing operation that is performed at desirable and commercially profitable commercial printing speeds. In part this is also because of the extent of the variability in toner stack heights within the toner image.

This problem is not easily solved in general and in particular where fusing is to be performed at production speeds. If insufficient energy is applied during the short time periods allotted for fusing at high production speeds, incomplete fusing can occur. Incomplete fusing can cause mechanical defects to arise in the printed images such as incomplete bonding of the toner pile to the receiver. This can lead to full or partial separation of the toner pile from the receiver resulting in an unacceptable image. Similarly, incomplete fusing can introduce weaknesses in the resultant toner pile such as pockets of unfused dry toner that can cause fracture of the toner itself, color mixing problems, gloss variations or partial separation of the toner powder from the receiver.

However, markedly increasing the amount of energy applied during a fusing step creates other problems in image formation. For example, as is described in commonly assigned U.S. Pat. Pub. No. 2009/014948 entitled "Enhanced Fuser Offset Latitude Method" filed by Cahill et al., on Dec. 18, 2007 using high temperatures for example on a roller type fuser can cause image artifacts. Such artifacts occur when toner that is in contact with a hot roller transitions to a glass transition temperature of the toner before toner that is closer to the receiver makes this transition. This can cause a portion of the toner to adhere to and contaminate the heated roller or other rollers associated with a fuser and can cause a variety of unwanted artifacts in an image. Similarly, as noted in the '671 patent, in non-contact fusing such as microwave increased energy can create artifacts such as blister formation of the toner on the receiver.

For these reasons, a fusing solution must be managed so that sufficient energy is transferred to a toner during a fusing process to allow fusing to occur and so that the artifacts created by applying too much energy during a short period of are not created.

It will be appreciated that reaching such a solution is made more difficult by the increased energy load that must be delivered to heat a thick toner pile to ensure full fusing during the short fusing process allowed during printing. It will also be appreciated that there are inherent limitations on the rate at which toner can transfer energy through a toner pile without creating the aforementioned hot offset problems.

What is needed is a system that can thoroughly fuse toner images having toner piles with toner stack heights that are greater than about 50 μm.

SUMMARY OF THE INVENTION

Methods are provided for printing and fusing a toner on a receiver having a toner pile that extends at least about 50 μm above a receiver. According to one aspect, a first energy is applied to raise a temperature of a first portion of the toner pile to a range of elevated temperature levels below a glass transition temperature of the toner, a second energy is applied to a temperature of a second portion of the toner pile above the glass transition temperature and to allow the second portion to transfer energy to the first portion. The second energy is provided at a level that allows the transferred energy to raise the temperature of the first portion from the range of elevated levels to the range of temperatures above the glass transition temperature.

DETAILED DESCRIPTION OF THE INVENTION

Figure 1:
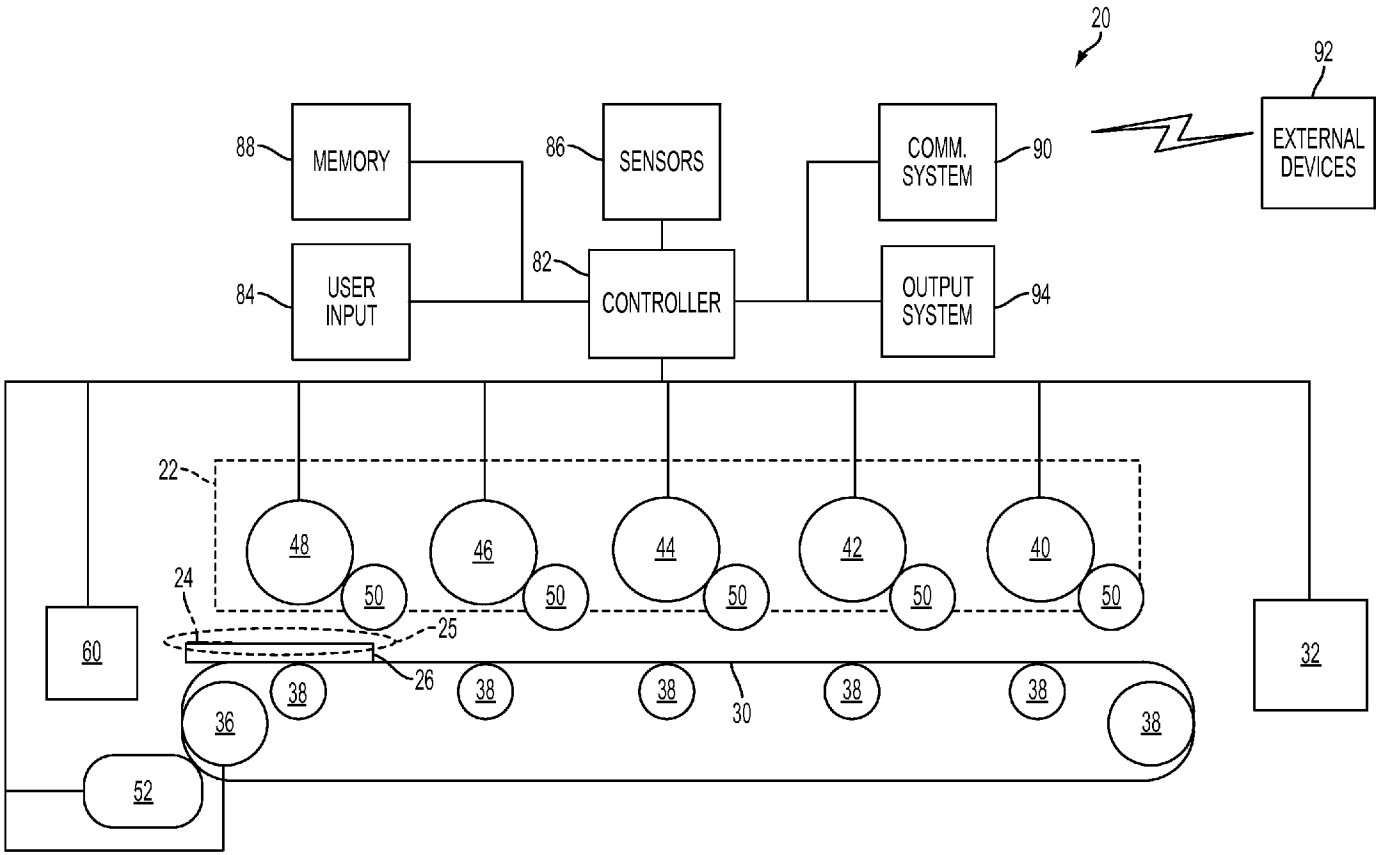
FIG. 1 is a system level illustration of one embodiment of an electrophotographic printer.

FIG. 1 is a system level illustration of an electrophotographic printer 20. In the embodiment of FIG. 1, electrophotographic printer 20 has an electrophotographic print engine 22 that deposits toner 24 to form a toner image 25 in the form of a patterned arrangement of toner stacks. The toner image can include any patternwise application of toner 24 and can be mapped according data representing text, graphics, photo, and other types of visual content, as well as patterns that are determined based upon desirable structural or functional arrangements of the applied toner 24.

Toner 24 is a material or mixture that contains toner particles, and that can form an image, pattern, or coating when electrostatically deposited on an imaging member including a photoreceptor, photoconductor, electrostatically-charged, or magnetic surface. As used herein, "toner particles" are the marking particles used in an electrophotographic print engine 22 to convert an electrostatic latent image into a visible image. Toner particles can also include clear particles that can provide for example a protective layer on an image or that impart a tactile feel to the printed image.

Toner particles can have a range of diameters, e.g. less than 8 μm, on the order of 10-15 μm, up to approximately 30 μm, or larger. When referring to particles of toner 24, the toner size or diameter is defined in terms of the median volume weighted diameter as measured by conventional diameter measuring devices such as a Coulter Multisizer, sold by Coulter, Inc. The volume weighted diameter is the sum of the mass of each toner particle multiplied by the diameter of a spherical particle of equal mass and density, divided by the total particle mass. Toner 24 is also referred to in the art as marking particles or dry ink.

Typically, receiver 26 takes the form of paper, film, fabric, metallicized or metallic sheets or webs. However, receiver 26 can take any number of forms and can comprise, in general, any article or structure that can be moved relative to print engine 22 and processed as described herein.

Returning again to FIG. 1, print engine 22 can be used to deposit one or more applications of toner 24 to form toner image 25 on receiver 26. A toner image 25 formed from a single application of toner 24 can, for example, provide a monochrome image.

A toner image 25 formed from more than one application of toner 24, (also known as a multi-part image) can be used for a variety of purposes, the most common of which is to provide toner images 25 with more than one color. For example, in a four toner image, four toners having subtractive primary colors, cyan, magenta, yellow, and black, can be combined to form a representative spectrum of colors. Similarly, in a five toner image various combinations of any of five differently colored toners can be combined to form other colors on receiver 26 at various locations on receiver 26. That is, any of the five colors of toner 24 can be combined with toner 24 of one or more of the other colors at a particular location on receiver 26 to form a color different than the colors of the toners 24 combined at that location.

In the embodiment that is illustrated, a primary imaging member (not shown) such as a photoreceptor is initially charged. An electrostatic latent image is formed by imagewise exposing the primary imaging member using known methods such as optical exposure, an LED array, or a laser scanner. The electrostatic latent image is developed into a visible image by bringing the primary imaging member into close proximity to a development station that contains toner 24. The toned image on the primary imaging member is then transferred to receiver 26, generally by pressing receiver 26 against the primary imaging member while subjecting the toner to an electrostatic field that urges the toner to receiver 26. The toner image 25 is then fixed to receiver 26 by fusing.

In the embodiment of FIG. 1 print engine 22 is illustrated as having an optional arrangement of five printing modules 40, 42, 44, 46, and 48, also known as electrophotographic imaging subsystems arranged along a length of receiver transport 28. Each printing module delivers a single application of toner 24 to a respective transfer subsystem 50 in accordance with a desired pattern as receiver 26 is moved by receiver transport 28. Receiver transport 28 comprises a movable surface 30, positions that moves receiver 26 relative to printing modules 40, 42, 44, 46, and 48. Surface 30 comprises an endless belt that is moved by motor 36, that is supported by rollers 38, and that is cleaned by a cleaning mechanism 52.

Figure 2:
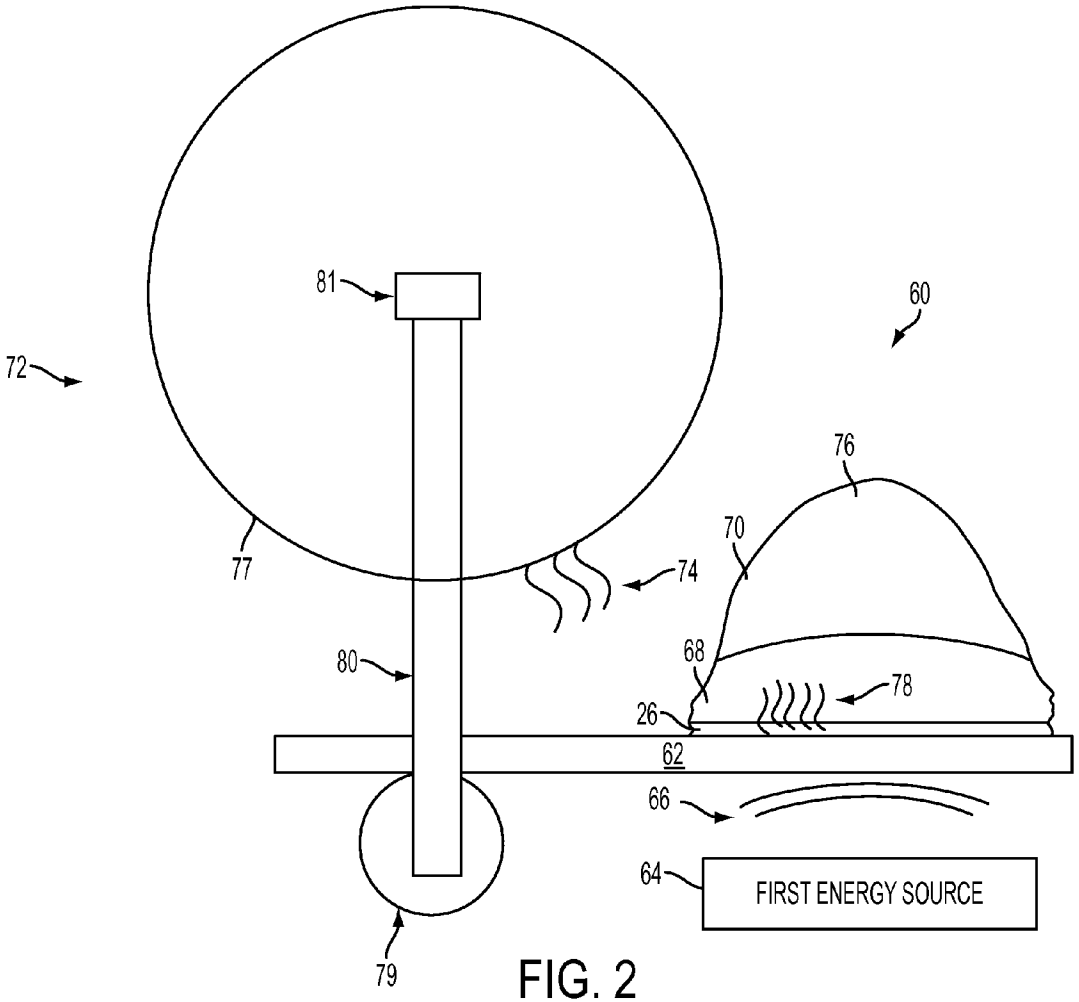
FIG. 2 is a view of one embodiment of a fuser during a fusing operation.

After toner image 25 is formed on receiver 26, receiver 26 is moved by receiver transport 28 to fuser 60. FIG. 2 shows one embodiment of fuser 60. In this embodiment, fuser 60 comprises a fuser receiver transport 62 that carries toner image 25 and receiver 26 past a first energy source 64 that provides, a first energy 66 that heats a first portion 68 of a toner pile 70 on receiver 26 and a second energy source 72 that provides a second energy 74 that heats a second portion 76 of toner pile 70.

First energy source 64 can comprise any known energy source that can convey a first energy 66 to cause a first portion 68 of toner pile 70 to be heated above an initial temperature range. In the embodiment shown in FIG. 2, first energy source 64 is illustrated in the example form of a microwave heater that applies first energy 66 by providing microwave energy that heats receiver 26 such that receiver 26 generates heat 78 that heats first portion 68 of toner pile 70. In other example embodiments, first energy source 64 can comprise a heater that applies a first energy 66 in the form of heat that can be transferred by way of radiation, conduction, convection or any other known heat transfer mechanism into or within first portion 68.

Second energy source 72 can comprise any known energy source that can convey a second energy 74 to cause a second portion 76 of toner pile 70 to be heated. In the embodiment shown in FIG. 2, second energy source 72 is illustrated in the example form of a heated roller 77 that cooperates with a support roller 79 and a pressure control system 80 to provide heat and pressure to transfer thermal energy directly to second portion 76 of toner pile 70. Pressure control system 80 can comprise any mechanical structure that can provide an amount of pressure between heated roller 77 and support roller 79 when a toner pile 70 and receiver 26 are situated therebetween. In other embodiments, second energy source 72 can include but is not limited to a heater that generates heat that can be transferred for example by way of radiation, conduction, convection, or any other known heat transfer mechanism into or within second portion 76.

In the embodiment of FIG. 2, an optional actuator 81 is provided that can cooperate with a embodiment of pressure control system 80 such as a spring tensioning system (not illustrated) to vary the amount of pressure applied between heated roller 77 and support roller 79.

Referring again to FIG. 1, electrophotographic printer 20 is operated by a controller 82 that controls the operation of print engine 22 including but not limited to each of the respective printing modules 40, 42, 44, 46, and 48, receiver transport 28, receiver supply 32, transfer subsystem 50, to form a toner image 25 on receiver 26 and to cause fuser 60 to fuse toner images 25 on receiver 26 in accordance with the methods claimed herein.

Controller 82 operates electrophotographic printer 20 based upon input signals from a user input system 84, sensors 86, a memory 88 and a communication system 90. User input system 84 can comprise any form of transducer or other device capable of receiving an input from a user and converting this input into a form that can be used by controller 82. For example, user input system 84 can comprise a touch screen input, a touch pad input, a 4-way switch, a 6-way switch, an 8-way switch, a stylus system, a trackball system, a joystick system, a voice recognition system, a gesture recognition system or other such systems. Sensors 86 can include contact, proximity, magnetic, or optical sensors and other sensors known in the art that can be used to detect conditions in electrophotographic printer 20 or in the environment-surrounding electrophotographic printer 20 and to convert this information into a form that can be used by controller 82 in governing printing and fusing. Memory 88 can comprise any form of conventionally known memory devices including but not limited to optical, magnetic or other movable media as well as semiconductor or other forms of electronic memory. Memory 88 can be fixed within electrophotographic printer 20, removable from electrophotographic printer 20 at a port, memory card slot or other known means for temporarily connecting a memory 88 to an electronic device. Memory 88 can also be connected to electrophotographic printer 20 by way of a fixed data path or by way of communication system 90.

Communication system 90 can comprise any form of circuit, system or transducer that can be used to send or receive signals to memory 88 or external devices 92 that are separate from or separable from direct connection with controller 82. Communication system 90 can connect to external devices 92 by way of a wired or wireless connection. In certain embodiments, communication system 90 can comprise a circuitry that can communicate with such separate or separable device using a wired local area network or point to point connection such as an Ethernet connection. In certain embodiments, communication system 90 can alternatively or in combination provide wireless communication circuits for communication with separate or separable devices using a Wi-Fi or any other known wireless communication systems. Such systems can be networked or point to point communication.

External devices 92 can comprise any type of electronic system that can generate wireless signals bearing data that may be useful to controller 82 in operating electrophotographic printer 20. For example and without limitation, an external device 92 can comprise what is known in the art as a digital front end (DFE), which is a computing device that can be used to provide images and or printing instructions to electrophotographic printer 20.

An output system 94, such as a display, is optionally provided and can be used by controller 82 to provide human perceptible signals for feedback, informational or other purposes. Such signals can take the form of visual, audio, tactile or other forms.

Figure 3:
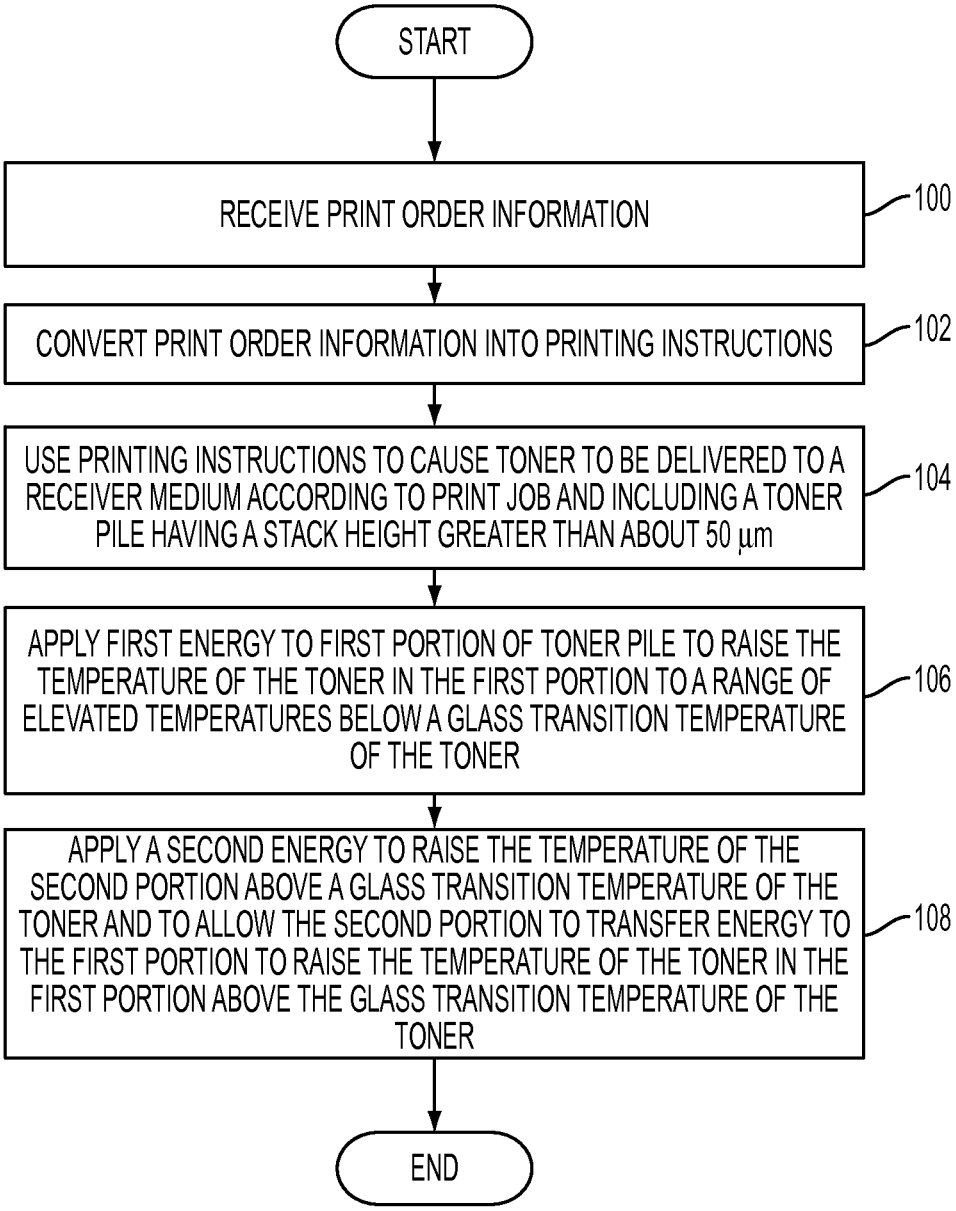
FIG. 3 shows a flow diagram for one embodiment of a method for printing and fusing.

FIG. 3 shows a first embodiment of a method for operating electrophotographic printer 20 to print and fuse an image having a toner pile with a stack height above 50 microns. As is shown in the embodiment of FIG. 3, a printing process begins when controller 82 receives print order information including image data and optionally job instructions (step 100). The print order information can be supplied for example from memory 88, communication system 90 or user input system 84. The image data can be supplied in any known form including but not limited to a digital image. Similarly, the job instructions can take any form and can, for example, without limitation, take the form of instructions as to which media to use, finishing instructions, preferred toner materials and the like. In some circumstances, the print order information can be in the form of a digital image having print imager information in the form of image metadata.

Controller 82 then converts the print order information into printing instructions which are sent to print engine 22, receiver transport 28, receiver supply 32 and which cause toner 24 to be applied in various amounts and in particular locations to the receiver 26 to yield, in combination, a superimposed image that corresponds to the image data for the image to be printed and the printing instructions (step 102). In some cases, this will require that controller 82 determines a set of color separation images and/or a clear toner image. In other cases, the digital image data provided to controller 82 can, for example, be provided from the color separation images that are generated by an external device 92 such as a computer known as a digital front end (DFE) and provided to electrophotographic printer 20, for example, from memory 88 or communication system 90.

Where one of the electrophotographic printing modules 40, 42, 44, 46, or 48 has clear toner 24 available, controller 82 can provide instructions to the printing module having the clear toner available causing the printing module to deposit the clear toner 24 to form, for example, images having a uniform layer of clear toner material for protective, decorative, or to form various visual effects or that can be created by selective application of such a clear donor material.

In the embodiment illustrated in FIG. 1, fifth electrophotographic printing module 48 is provided with a clear toner (i.e. one lacking pigment) for application to receiver 26 and can be operated by controller 82 to form toner piles having stack heights that are greater than about 50 microns. In certain embodiments such clear toner 24 can comprise toner particles that have, for example, a diameter between 15 μm and 30 μm. In other embodiments the diameter of the particles in toner 24 can be for example between 20 μm and 30 μm.

Figure 4:
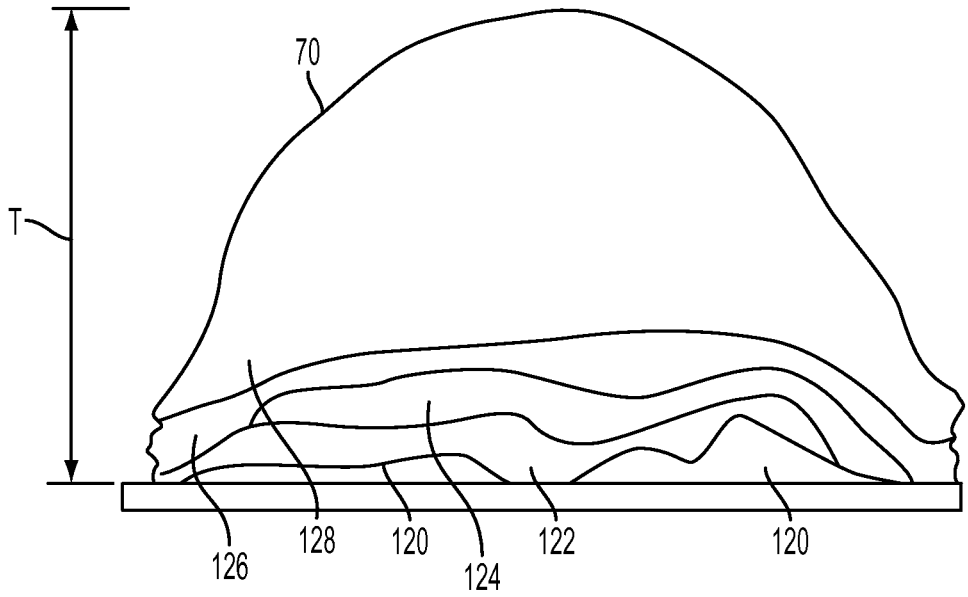
FIG. 4 is an elevational cross section view of a segment of a high stack height toner pile.

FIG. 4 (not to scale) illustrates a cross section of a toner pile 70 to formed on receiver 26 during a single pass through the five modules, with printing module 48 apply clear toner 128 in a manner that creates high toner stack heights. In this illustration, five applications of toner 120, 122, 124, 126, and 128 have been transferred, in registration to receiver 26 to form a five component image. Here, printing module 48 has applied a clear toner 128 to form a toner pile 70 having a toner stack height (T) for example on the order of 50 to 500 μm. The stack height T can be produced by selectively building up layer upon layer of toner 24 having particles of a standard general average mean volume weighted diameter of less than 9 μm, where for example each layer has a lay down coverage of 0.4 to 0.5 mg/cm$^2$.

Alternatively, several layers of the standard size particles of toner 24 can be selectively covered by clear toner particles of a larger general average median volume weighted diameter of 12-30 μm. Here, the particles of toner 24 are clear (i.e., not pigmented) and have a lay down coverage of at least 2 mg/cm$^2$. Using small marking particles for the non-raised image is preferred because it allows for high quality images even when the large clear particles are deposited on top.

The deposition of the clear toner can also be controlled by using a Fourier series to mathematically map the stack height of the toner piles forming toner image 25. In this manner, controller 82 can generate the electrostatic latent image corresponding to the clear toner deposition is by controlling the exposure, which is, itself, programmed to vary the exposure according to the Fourier series.

The high toner stack heights can be used, for example, to impart a background texture to an image, as described in U.S. Pat. No. 7,468,820, entitled "Profile Creation for Texture Simulation with Clear Toner" issued to Ng et al. on Dec. 23, 2008 and U.S. Publication 2009/0297970, entitled "Toner Composition for Preventing Image Blocking", filed by Tyagi et al. on May 4, 2009. That is, using variable data, for example, from a database having any of a plurality of background texture, can be formed on an image by selective application of toner stack heights greater than about 50 μm; provide the appearance of a painter's canvas, an acrylic painting, a basketball (pigskin), sandstone, sandpaper, cloth, carpet, parchment, skin, fur, or wood grain. The resultant texture is preferably periodic, but can be random or unique. It is also preferable to create textures with a low frequency screening algorithm. Using variable data, in this way to provide patterns of high toner stack heights enables every printed page to contain unique information, with its own particular tactile feel. In order to improve reproduction of the colors in areas containing raised image effect, it may be desirable to build a new color profile based on the raised information.

Typically, a clear toner 24 applied on top of a color image to form a three-dimensional texture. It should be kept in mind that texture information corresponding to the clear toner image plane need not be binary. In other words, the quantity of clear toner called for, on a pixel by pixel basis, need not only assume either 100% coverage or 0% coverage; it may call for intermediate "gray level" quantities, as well.

In an area of the toner image 25 to be covered with a clear toner for three-dimensional texture, the color may change due to the application of the clear toner. For this approach, two color profiles are created. The first color profile is for 100% clear toner coverage on top and the second color profile is for 0% clear toner coverage on top. On a pixel by pixel basis, proportional to the amount of coverage called for in the clear toner image plane, a third color profile is created, and this third color profile interpolates the values of the first and second color profiles. Thus, a blending operation of the two color profiles is used to create printing values. In a preferred embodiment, a linear interpolation of the two color profile values corresponding to a particular pixel is performed. It is understood, however, that some form of non-linear interpolation may be used instead. This technique is especially useful when the spatial frequency of the clear toner texture is low.

The second approach may be used when the spatial frequency of the clear toner texture is high. In such case, only one color profile may be needed for that textured image. One option is to simply use the ICC color profile of the original system for all textures, i.e., the ICC color profile that assumes there is no clear toner. In such case, we simply accept the fact that the appearance of the colored image will change a bit since the absolute color will differ from the calibrated color. However, there will not be an observable color difference within a uniform color region, even though the color is not quite accurate. A second option is to build a new ICC color profile with that particular three-dimensional clear toner texture surface. In this manner, the macro "color accuracy" problem is corrected, while the color artifact from pixel-to-pixel is not noticeable. Furthermore, a library of such texture-modified ICC color profiles may be built up over time for use whenever an operator wishes to add a previously defined texture to a profile, as discussed above. In implementing such a method controller 82 can, for the second approach, automatically invoke just one of these two options, or may instead display a choice of the two options to an operator, perhaps with one of the options being the default.

After a toner image 25 having high toner piles is created, controller 82 causes receiver 26 to be forwarded for fusing. In the embodiment of FIG. 1, controller 82 does this by causing receiver transport 28 to move receiver 26 to fuser 60 such that receiver 26 is passed fuser receiver transport 62.

As is shown in FIGS. 2 and 3, controller 82 then causes receiver 26 to be moved proximate to first energy source 64 such that first energy source 64 can apply a first energy 66 to raise a temperature of a first portion 68 of toner pile 70. Controller 82 causes first energy source 64 to apply energy to first portion 68 of toner pile 70 to raise the temperature of first portion 68 to a range of elevated temperature levels that is below a glass transition temperature of the toner (step 106). Accordingly, as receiver 26 is moved from first energy source 64 the first portion 68 has substantially no toner 24 that is above the glass transition temperature. However, the amount of energy required to cause the first portion 68 to move into the range of glass transition temperatures is substantially lower than the amount of energy that would be required to cause the first portion 68 to heat from an ambient temperature range into range of the glass transition temperatures. Controller 82 then causes fuser receiver transport 62 to move receiver 26 to a position proximate to the second energy source 72.

Figure 5:
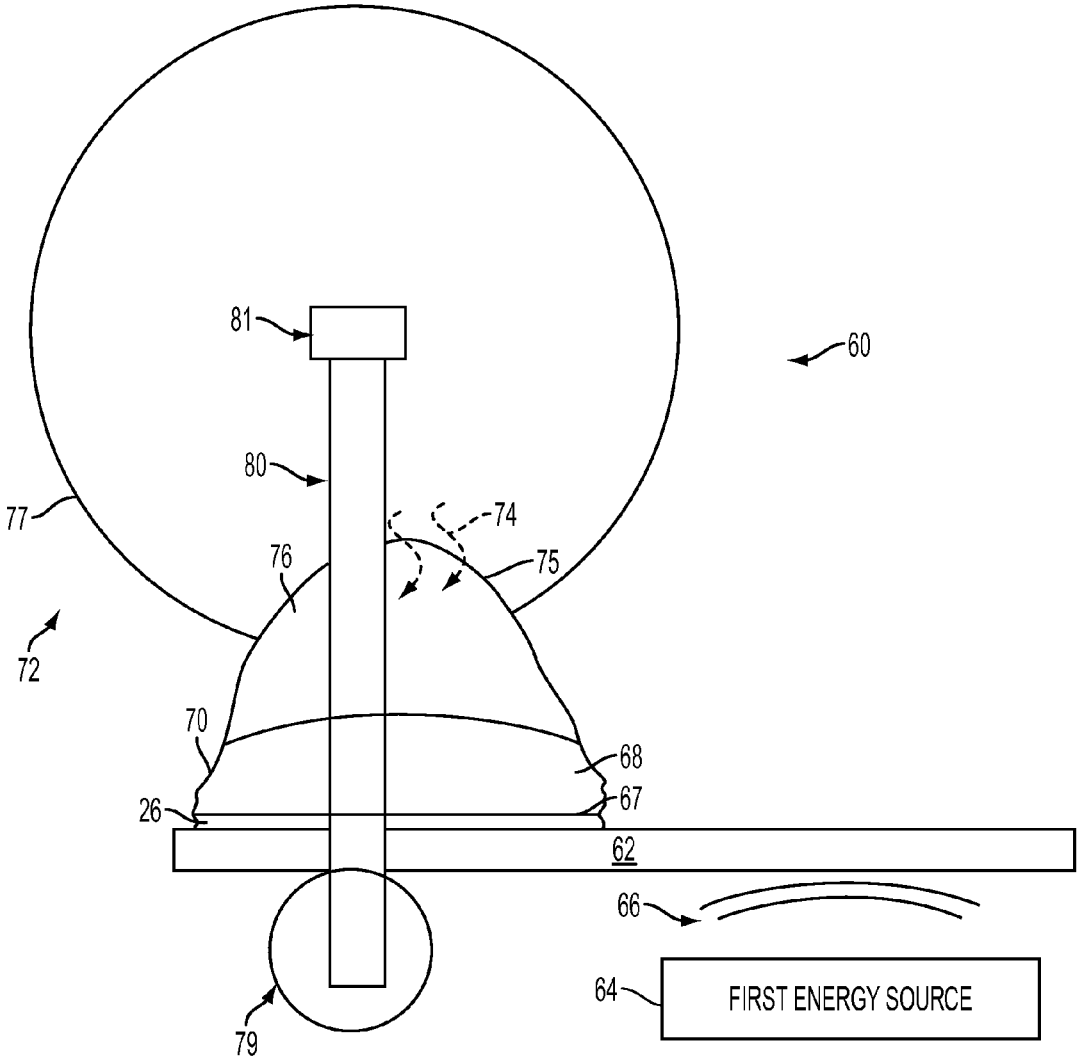
FIG. 5 is a view of the embodiment of FIG. 2 during a fusing operation.

As is shown in FIG. 5, controller 82 then causes second energy source 72 to apply a second energy 74 to raise the temperature of the second portion 76 of toner pile 70 (step 108).

In this embodiment, the amount of energy applied to the second portion 76 of the toner pile 70 is determined to achieve two results: to allow second portion 76 to transfer sufficient energy into first portion 68 to cause the first portion 68 to heat from the range of elevated temperature levels to a range of temperatures above the glass transition temperature and to bring the temperature of the second portion 76 above the glass transition temperature of the toner, such that the first portion 68 and the second portion 76 are in a glassy state for a common period of time.

Both first energy 66 and second energy 74 are selected so that neither first energy 66 nor the second energy 74 is applied in an amount or at a rate that causes toner 24 to become damaged. The range of elevated temperatures is preferably as close to the glass transition temperature as can be achieved within a fusing exposure time and without causing damage or premature fusing of toner 24 in first portion 68.

In certain embodiments, it may be useful for electrophotographic printer 20 to provide a uniform production rate for images having high toner stack heights as well as conventional toner stack heights. This will of course require that there be a generally consistent exposure time for fusing. In this regard, in certain embodiments, an electrophotographic printer 20 can use one of the first energy source and the second energy source to fuse toner on a receiver having a toner stack with toner stack heights that are below 50 microns during a first range of exposure times. To match this production rate, the first energy and second energy are applied so that the range of temperatures of the first portion and the second portion can be raised to the glass transition temperature to fuse high toner stack heights within the first range of exposure times.

In the embodiment of fuser 60 illustrated in FIGS. 2 and 5, first energy source 64 applies first energy 66 at a first surface 67 of toner pile 70 and the second energy source 72 applies the second energy 74 at a second, opposing surface 75 of toner pile 70. This can help to reduce the risk that portions of the toner in toner pile 70 will become overheated.

As is shown in FIGS. 2 and 5 second energy source 72 comprises a heated roller 77 and support roller 79 creating a nip through which a toner pile 70 that forms part of a toner image 25 on receiver 26 is passed. As toner pile 70 passes between heated roller 77 and support roller 79 pressure and heat are applied thereto to fuse toner pile 70. To protect the integrity of toner pile 70 during fusing, the heated roller 77 is formed from thick soft thermally conductive elastomers having smooth lower surface energy materials on an outer surface thereof. As is illustrated in FIG. 5 the thick soft thermally conductive elastomers conform to the toner pile 70 so as to avoid damaging the toner pile 70. In this regard the elastomers used on heated roller 77 will have a thickness that is sufficient to conformally receive a toner pile 70 having a stack height about 50 μm to 500 μm. Any known low surface energy materials can be used for the outer surface of heated roller 72.

To further protect toner pile 70, the optional pressure control system 80 can be used to reduce pressure between heated roller 77 and the support roller 79 during the fusing of toner piles 70 having stack heights that are about 50 μm or more. In the embodiment that is illustrated in FIGS. 2 and 5, pressure control system 80 comprises a spring tensioning system (not illustrated) with a conventional mechanical adjustment that is driven by an optional actuator 81 which, for example, can comprise a motor that is appropriately linked to pressure control system 80.

It will be appreciated that not every image fused by fuser 60 will have an image recorded thereon that has toner piles with stack heights on the order of 50 μm. Accordingly, for energy conservation and other efficiency considerations, it is useful to provide an electrophotographic printer 20 that has the capability to adjust the fusing process to provide an appropriate fusing solution for fusing toner piles having conventional toner stack heights as well as toner piles having toner stack heights that are greater than about 50 μm.

Figure 6:
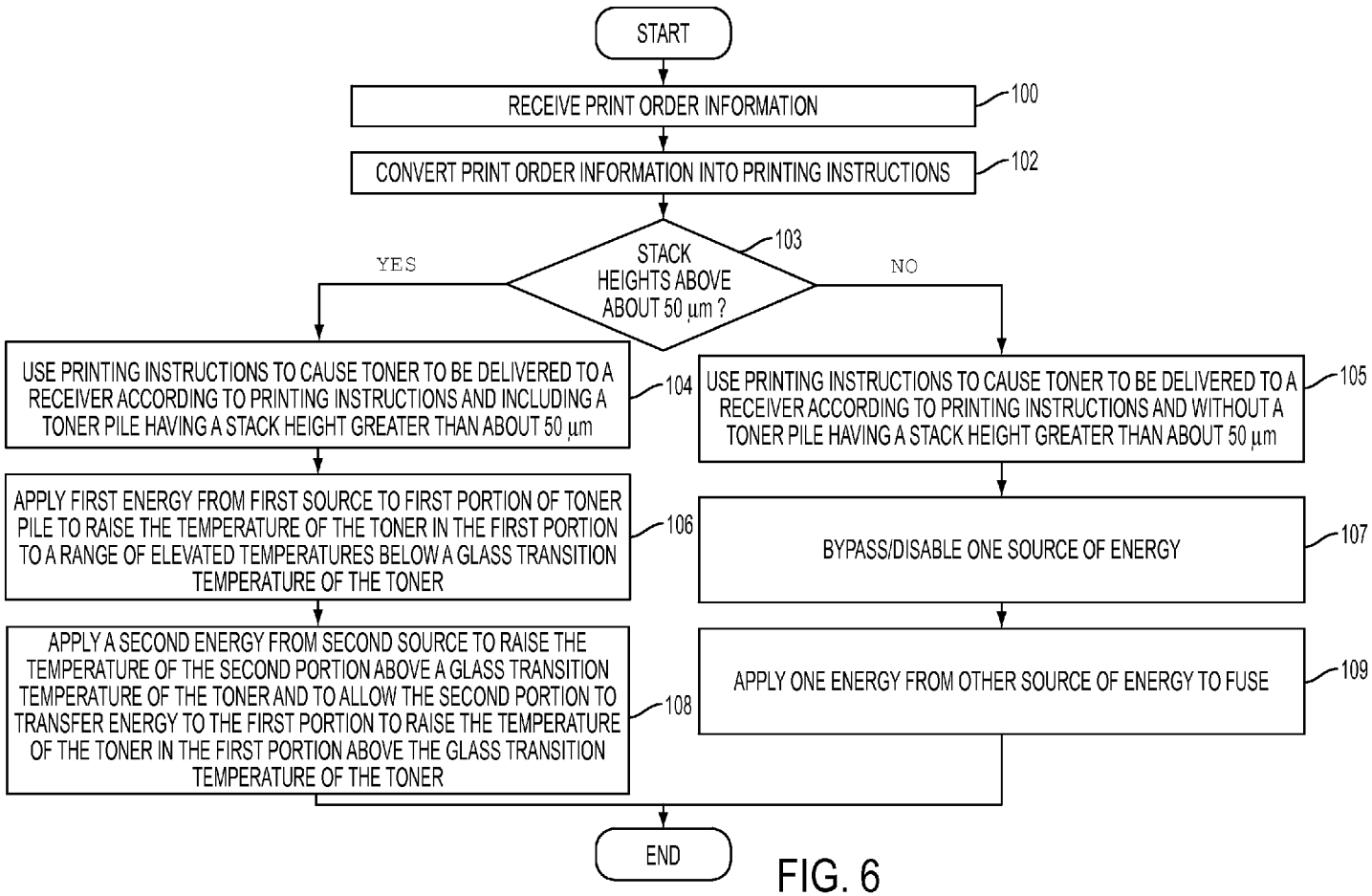
FIG. 6 shows a flow diagram for an embodiment of a method for printing and fusing.

As is shown in the flow diagram of FIG. 6 controller 82 optionally can be adapted to adjust the fusing process based upon whether the print order information calls for images that have toner stack heights that are greater than about 50 μm. As is shown in FIG. 6, in this embodiment, controller 82 receives a print order information (step 100) and converts the print order information into printing instructions (step 102) in a manner that is consistent with what is disclosed above. However, controller 82 is further adapted to determine whether a particular receiver has toner with stack heights that are within a range of toner stack heights that can be fused using only one of the first energy source and the second energy source during an available fusing exposure period (step 103). In the embodiment that is illustrated, controller 82 makes this determination based upon whether the printing instructions require toner stack heights to be above 50 μm. If the controller determines that the printing instructions do call for such stack heights, then controller 82 can execute steps 104, 106, and 108 as is generally described above.

Figure 7:
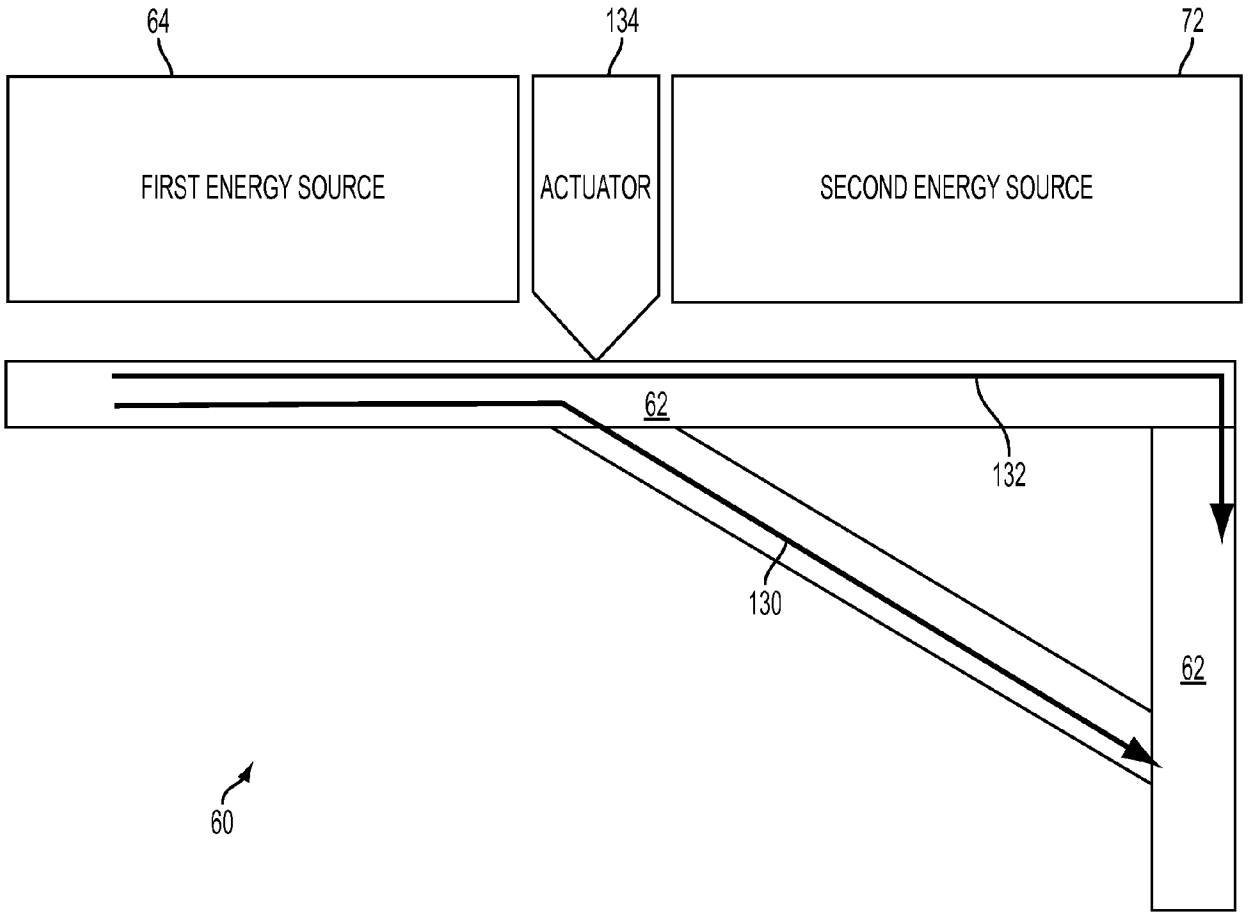
FIG. 7 shows a view of an embodiment of a fuser.

However, when controller 82 determines that the printing instructions do not require the formation of toner stack heights that are at least around 50 μm, controller 82 uses the printing restrictions to cause toner to be delivered to receiver 26 according to printing instructions and without a toner pile having a stack height that is greater than 50 μm (step 105). Controller 82 then causes one of the first energy source and second energy source to be deactivated during fusing operations (step 107) such as by cutting off the power the unused toner energy source or by sending instructions causing the energy source to deactivate. Accordingly energy is applied from only one source of energy to fuse images of this type. Alternatively, as shown in FIG. 7, electrophotographic printer 20 can include fuser receiver transport 62 having a first flow path 130 for receivers having toner 24 with toner stack heights that are below about 50 μm that by-passes one of the energy sources, and a second flow path 132 for receivers having toner with toner stack heights that are above about 50 μm and that do not bypass either energy source (step 107). Here energy is applied from only one source of energy to fuse images of this type (step 109). In such an embodiment, a flow actuator 134 can be used for directing receiver 26 between the first flow path 130 and the second flow path 132, and controller 82 can operate flow actuator 134 to direct a receiver along the first flow path 130 or the second flow path 132 based on whether receiver 26 has a toner piles 70 with a stack height that is above about 50 μm.

In still another embodiment, first energy source 64 can be adapted to apply sufficient energy to first portion 68 to allow the first portion 68 to partially heat the second portion 76 so that the second energy 74 begins heating second portion 76 at a temperature that is above an initial temperature of the toner 24. This will reduce the amount of energy required of second energy 74 as compared to an amount of energy that second energy 74 would be required to apply to an unheated second portion 76.

Figure 8:
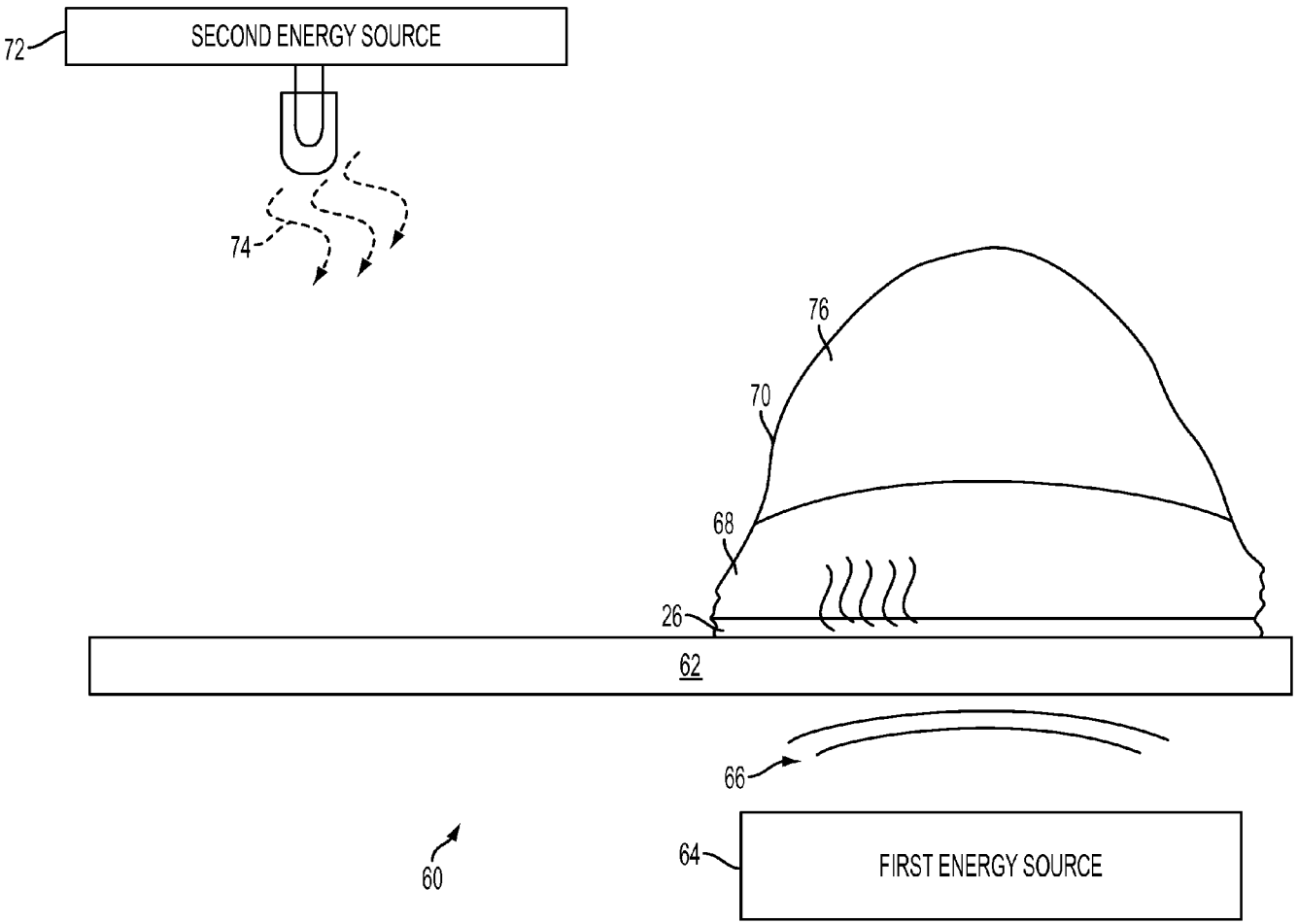
FIG. 8 shows a view of an embodiment of a fuser.

In other embodiments, first energy source 64 and second energy source 72 can take any of a variety of forms. For example, in the embodiment of FIG. 8, first energy source 64 takes the form of a microwave system for heating receiver 26, while second energy source 72 takes the form of a flash fusing system. In still other embodiments, first energy source 64 or second energy source 72 can comprise, for example and without limitation, radiant heat fusers, hot air impingement fusers, and/or inductive heaters. To protect the toner pile 70, first energy source 64 will typically be a non-contact type energy source.

Figure 9:
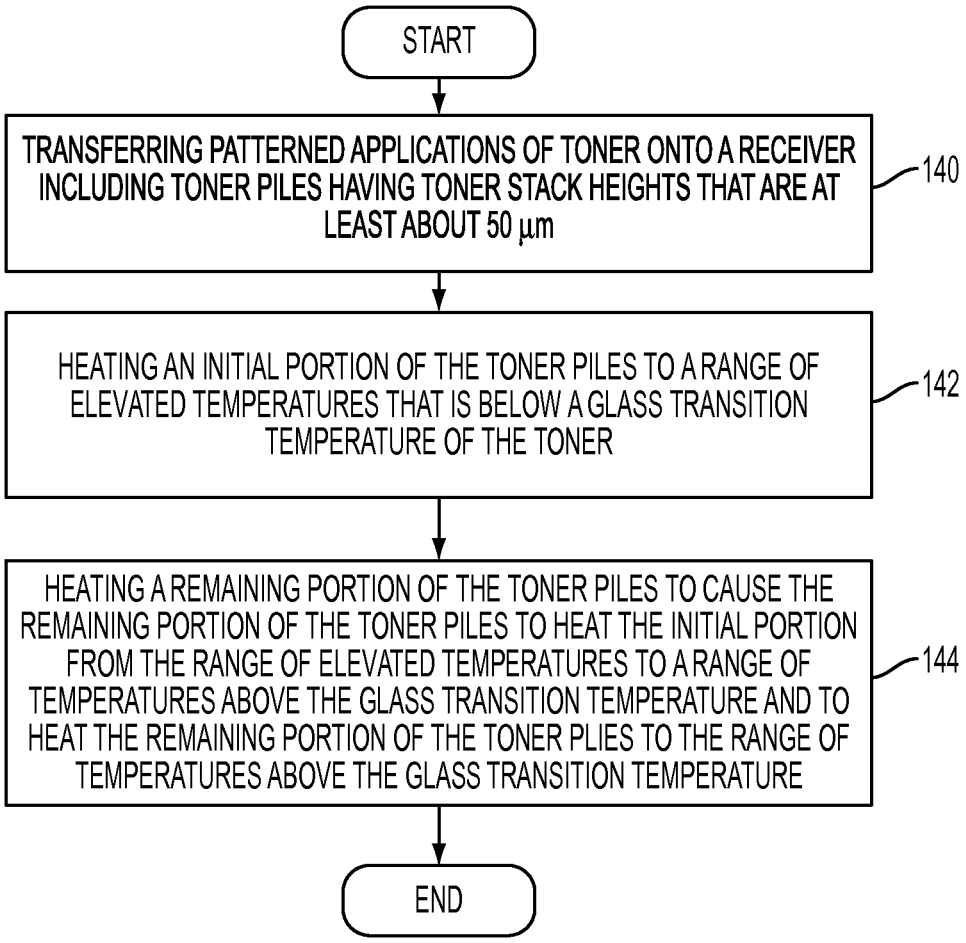
FIG. 9 shows another embodiment of a method for fusing.

As shown in FIG. 9, another embodiment, the printing method comprises transferring patterned applications of toner onto a receiver including toner piles having toner stack heights that are at least about 50 μm (step 140). This can be done generally as described above.

A initial portion of the toner piles is then heated to a range of elevated temperatures that is below a glass transition temperature of the toner (step 142). The initial portion can be heated in a single step or process for multiple steps.

A remaining portion of the toner piles is then heated to cause the remaining portion of the toner piles to heat the initial portion from the range of elevated temperatures to a range of temperatures above the glass transition temperature and to heat the remaining portion of the toner piles to the range of temperatures above the glass transition temperature (step 144).

In certain embodiments, the heating of the initial portion can apply a heat to a first surface of the toner piles while the heating of the remaining portion applies heat to a second surface of the toner piles with the second surface being opposite from the first surface. In other embodiments, the heating of one of the portions can be performed by conforming a heated surface to the toner piles and transferring heat from the conforming surface into the toner piles.

The invention has been described in detail with particular reference to certain preferred embodiments thereof, but it will be understood that variations and modifications can be effected within the spirit and scope of the invention.

PARTS LIST

20 printer
22 print engine
24 toner
25 toner image
26 receiver
28 receiver transport
30 surface
32 receiver supply
36 motor
38 rollers
40 printing module
42 printing module
44 printing module
46 printing module
48 printing module
50 transfer subsystem
52 cleaning mechanism
60 fuser
62 fuser receiver transport
64 first energy source
66 first energy
67 first surface
68 first portion
70 toner pile
72 second energy source
74 second energy
75 second surface
76 second portion
77 heated roller
78 heat
79 support roller
80 pressure control system
81 actuator
82 controller
84 input system
86 sensors
88 memory
90 communication system
92 external devices
100 receive print order step
102 convert step
103 determining step
104 form toner image step
105 print step
107 bypass/disable step
108 apply second energy step
109 fuse with one fuser step.
120 first application of toner
122 second application of toner
124 third application of toner
126 fourth application of toner
128 fifth application of toner
130 first flow path
132 second flow path
134 flow actuator
140 transfer toner step
142 heat initial portion step
144 heat remaining portion step

What is claimed is:

1. A method for fusing a toner on a receiver having a toner pile that extends at least about 50 μm above the receiver, the method comprising:

applying a first energy to raise a temperature of a first portion of the toner pile to a range of elevated temperature levels below a glass transition temperature of the toner; and applying a second energy to raise a temperature of a second portion of the toner pile above the glass transition temperature of the toner and to allow the second portion to transfer energy to the first portion;

wherein the second energy is provided at a level that allows the transferred energy to raise the temperature of the first portion from the range of elevated temperature levels to the range of temperatures above the glass transition temperature for the toner; and wherein one of the steps of applying a first energy and applying a second energy is further adapted to apply sufficient energy to raise the temperature of a toner pile that extends less than about 50 μm above the receiver to the range of temperatures above the glass transition temperature, such that the method further comprises a step of determining that a receiver does not have a toner pile that extends at least about 50 μm above a receiver and applying only the further adapted energy to the receiver.

2. The method of claim 1, wherein the first energy is applied at a first surface of the toner pile and the second energy is applied at a second surface of the toner pile, with the second surface opposing the first surface.

3. The method of claim 1, wherein the first energy applies sufficient energy to the first portion to allow the first portion to partially heat the second portion so that the second energy begins heating the second portion with the second portion being at a temperature that is above an initial temperature of the toner.

4. The method of claim 1, wherein the first energy heats the first portion without contacting the first portion.

5. A printing method comprising the steps of:

transferring a pattern of a toner to a receiver including toner piles having high stack heights of at least 50 microns;

heating a first portion of the toner piles to a first range of temperatures above an initial temperature range but below a glass transition temperature; and heating a second portion of the toner piles within an exposure time period to cause the temperature of the second portion to rise and to cause the second portion to heat the first portion;

wherein sufficient heat is transferred during the heating of the second portion to heat the second portion to a range of temperatures above a glass transition temperature of the toner, and to allow the second portion to transfer sufficient heat to the first portion to heat the first portion from a first range of temperatures to a range of temperatures above the glass transition temperature, and wherein the method further comprising the steps of directing receiver along a first flow path or a second flow path based on whether the receiver has toner with stack heights above about 50 μm.

6. The method of claim 5, wherein the first heating heats the first portion to allow the first portion to partially heat the second portion before the second heating begins to heat the second portion, wherein the amount of heat required to heat the second portion is reduced as compared to an amount of heating that would have to be made to an unheated second portion.

7. The method of claim 5, further comprising the steps of receiving print order information, determining that the print order information comprises instructions for delivering toner with stack heights that are above about 50 μm to a receiver, and causing a pressure that is applied during heating of the second portion to be reduced from a pressure applied during heating of an image having toner stack heights that are below about 50 μm.

8. The method of claim 5, wherein the step of heating of the first portion is done without contacting the first portion.

9. The method of claim 5, wherein the step of transferring a portion of toner to a receiver comprises using a Fourier series to mathematically map the heights of the stack heights of toner piles forming the toner image; and transferring toner according to the map.

10. The method of claim 5, wherein said step of heating the second portion is performed by conforming a heated surface to the toner pile and transferring heat from the conforming surface into the toner pile.

11. A printing method comprising the steps of;

transferring patterned applications of toner onto a receiver including toner piles having toner stack heights that are at least about 50 μm;

heating an initial portion of the toner piles to a range of elevated temperatures that is below a glass transition temperature of the toner; and heating a remaining portion of the toner piles to cause the remaining portion of the toner piles to heat the initial portion from the range of elevated temperatures to a range of temperatures above the glass transition temperature and to heat the remaining portion of the toner piles to the range of temperatures above the glass transition temperature;

wherein one of the steps of heating applies sufficient heat to raise the temperature of toner piles having a stack height of less than about 50 μm to the range of temperatures above the glass transition temperature of the toner without heat being supplied by the other one of the steps of heating.

12. The method of claim 11, wherein the heating of the initial portion applies heat to a first surface of the toner piles and the heating of the remaining portion applies heat to a second surface of the toner piles with the second surface opposing the first surface.

13. The method of claim 11, wherein the step of transferring toner comprises using a Fourier series to determine toner stack heights and transferring toner to form the determined stack heights.

14. The method of claim 11, wherein said step of heating the remaining portion is performed by conforming a heated surface to the toner pile and transferring heat from the conforming surface into the toner pile.

* * * * *